US006082922A

United States Patent [19]

Cheng

[11] Patent Number: 6,082,922

[45] Date of Patent: Jul. 4, 2000

[54] FOLDABLE JOINT FOR A PLAYPEN

[76] Inventor: Ching-Wen Cheng, 3th Fl., No. 100, Wenlin N. Rd., Peitou Dist., Taipei, Taiwan

[21] Appl. No.: 09/133,060

[22] Filed: Aug. 12, 1998

[51] Int. Cl.[7] ..... A47D 7/00

[52] U.S. Cl. ..... 403/102; 403/329; 403/92; 5/99.1

[58] Field of Search ..... 903/102, 101, 903/100, 93, 91, 23, 321, 325, 329; 5/99.1, 98.1

[56] References Cited

U.S. PATENT DOCUMENTS

| | | | |
|---|---|---|---|
| 4,247,216 | 1/1981 | Pansini | 403/329 X |
| 5,560,055 | 10/1996 | Ziegler | 5/99.1 |
| 5,590,974 | 1/1997 | Yang | 403/329 X |
| 5,611,634 | 3/1997 | Wang | 5/99.1 X |
| 5,803,650 | 9/1998 | Wu | 5/99.1 X |
| 5,906,013 | 5/1999 | Wang | 403/102 X |

*Primary Examiner*—Lynne H. Browne
*Assistant Examiner*—John R. Cottingham
*Attorney, Agent, or Firm*—Thomas, Kayden, Horstemeyer & Risley, L.L.P.

[57] ABSTRACT

A foldable joint for a playpen comprises a seat having two spaced apart side plates one of which defines holes respectively in both end and an integral connecting plate; two tubes respectively pivotally mounted on the end of the seat by a pivot, each having a first aperture and second aperture defined therein; and two U-shaped trips respectively disposed in the tubes, each having a first lug being inserted through the first aperture of the tube and the hole of the side plate, and a second lug being inserted through the second aperture of the tube; whereby, the tubes can be folded upward when the first lugs are pressed inward.

4 Claims, 10 Drawing Sheets

FOLDABLE JOINT FOR A PLAYPEN

BACKGROUND OF THE INVENTION

1. Field of the Invention

The present invention relates to a foldable joint for a playpen, and more particularly to a foldable joint for a playpen which is safe for a baby in the playpen.

2. Description of Related Art

A playpen generally is designed with foldable joints so that the playpen can be stored.

Referring to FIGS. 11 and 12, a conventional joint for a playpen comprises a seat (50), an arched plate (70) and two tubes (55). The seat (50) has two side plates (51) which are spaced apart, and an integral connecting plate (52). A hole (54) is defined in the central portion of the seat (50). Two apertures (53) are respectively defined beside the hole (54). The tubes (55), each having a through-hole (56) defined therein, are respectively pivotally mounted on the seat (50). A U-shaped trip (60) having two lugs (61) respectively formed on the front end thereof is disposed within the tube (55). The lugs will be inserted through the through-holes (56) and the apertures (53). The arched plate (70) is mounted on the seat (50) by a pin (55). Protrusions (73) are integrally formed on the internal wall of the arched plate (70). These protrusions (73) are aligned with the apertures (53) of the seat (50). Pressing the protrusions (73) will inwardly move the lugs (61), so that the tubes (55) can be pivoted about the seat (50).

However, if the protrusions (73) are not aligned with the apertures (53) due to careless assembling, the lugs (61) can not be inwardly moved by pressing the protrusions (73), and the tubes (55) can not be pivoted. Another problem is that a baby in the playpen will be harmed if the joint is wrongly pressed and causes the playpen to unexpectedly fold.

A foldable joint for a playpen in accordance with the present invention tends to mitigate and/or obviate the aforementioned problem.

SUMMARY OF THE INVENTION

The main object of the present invention is to provide a joint for a playpen which is ensured to fold when correctly operated.

Another object of the present invention is to provide a joint for a playpen which will prevent it from inadvertently folding when improperly operated.

Other objects, advantages and novel features of the invention will become more apparent from the following detailed description when taken in conjunction with the accompanying drawings.

DETAILED DESCRIPTION OF THE PREFERRED EMBODIMENT

Figure 1:
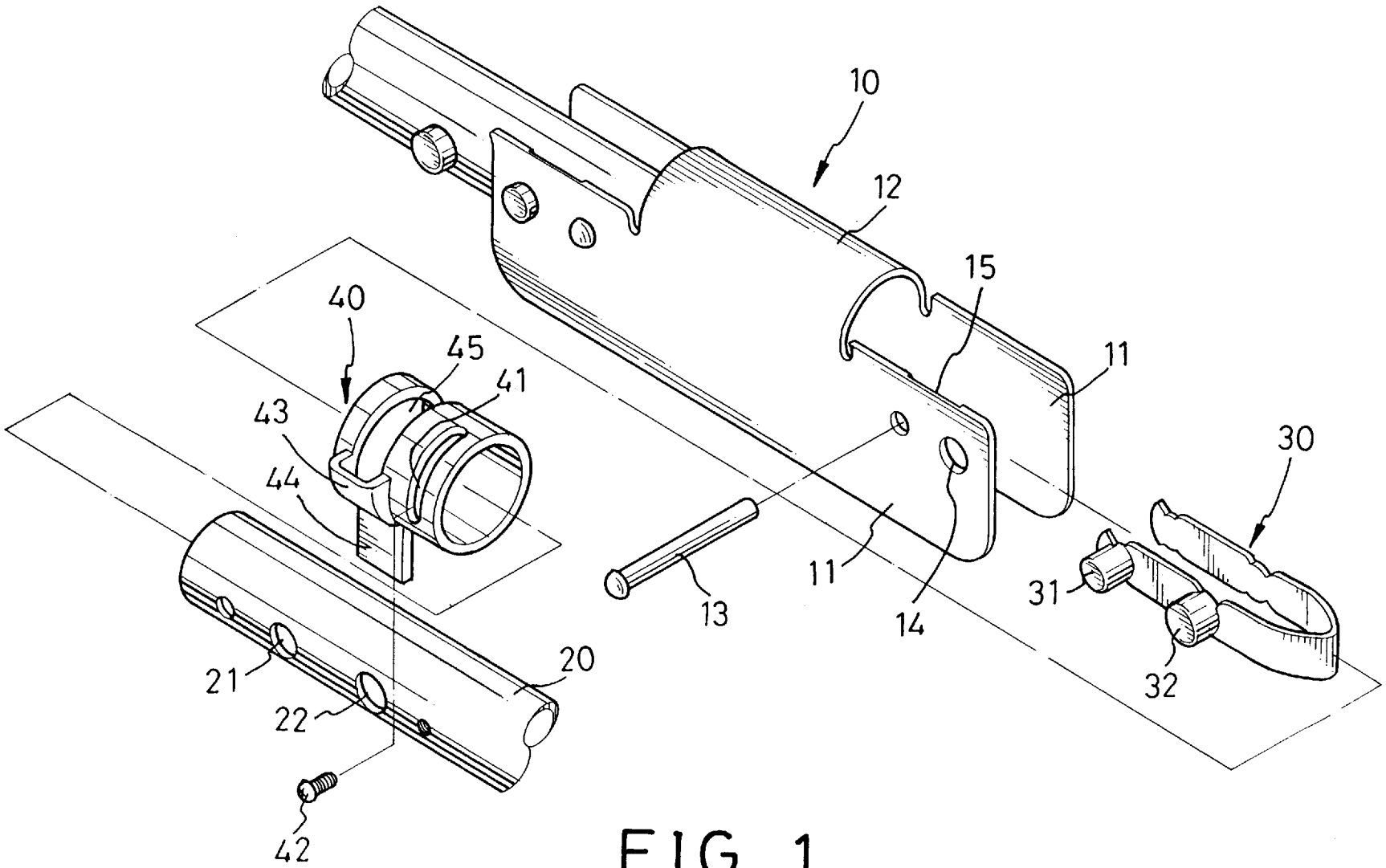
FIG. 1 is a exploded view of a first preferred embodiment of the joint with a rotatable sleeve in accordance with the present invention.
Figure 2:
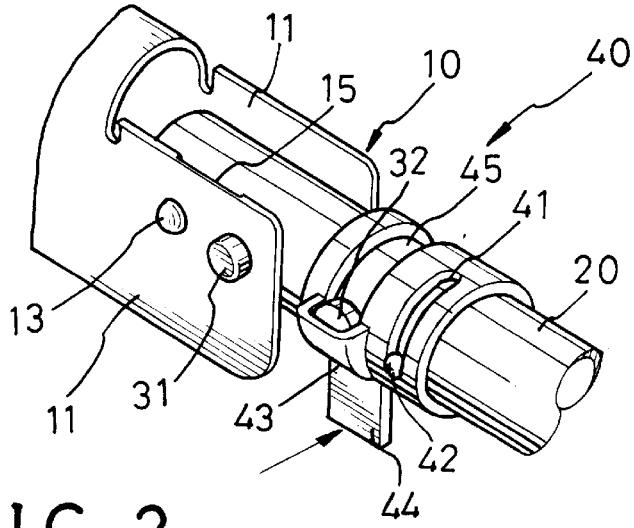
FIG. 2 is a partially perspective view of the preferred embodiment of the present invention.

Referring to FIGS. 1 and 2, the foldable joint for a playpen according to the present invention comprises a seat (10) and two tubes (20).

The seat (10) has two side plates (11) which are spaced apart and an integral connecting plate (12). One side plate (11) respectively defines a hole (14) at both ends thereof. Two guide grooves (15) are respectively defined in the internal wall of the side plate and above the holes (14).

The tubes (20) are pivotally mounted on the ends of the seat (20) by pins (13). Each of tubes (20) has a first aperture (21) and second aperture (22) defined therein. A U-shaped trip (30), which has a first lug (31) and a second lug (32) integrally formed thereon, is disposed in the tube. The first lug (31) of the trip (30) is inserted through the first aperture (21) and the hole (14) of the seat (10), and the second lug (32) is inserted through the second aperture (22) of the trip (30). The height of the first lug is less than that of the second lug (32), so that the first lug (31) is ensured to move inwardly behind the side plate (11) when the second lug (32) is pressed.

A rotatable sleeve (40) is respectively mounted around each tube (20). The rotatable sleeve (40) defines a channel (45) to receive the second lug (32) and forms a shield (43) to cover the second lug (32). The sleeve (40) further comprises a slot (41) defined therein for receiving a screw (42) to fasten in the tube (20) to axially fixed the sleeve (40). A tongue (44) is integrally formed on the rotatable sleeve (40) to facilitate rotating the sleeve (40).

Figure 4:
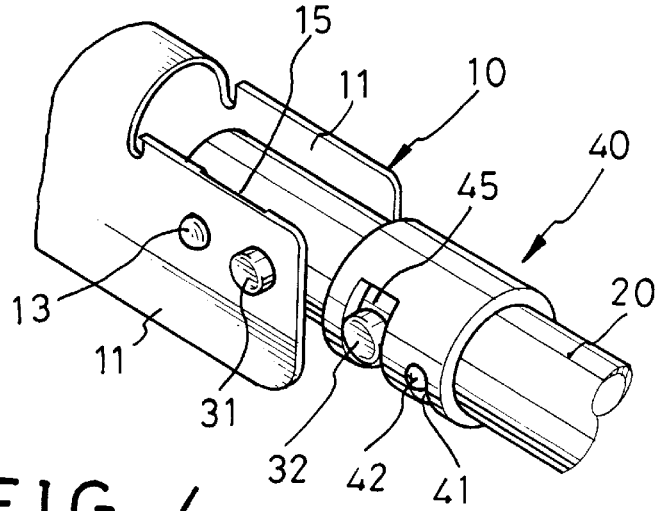
FIG. 4 is a partially perspective view showing the rotatable sleeve being rotated to expose a second lug.
Figure 6:
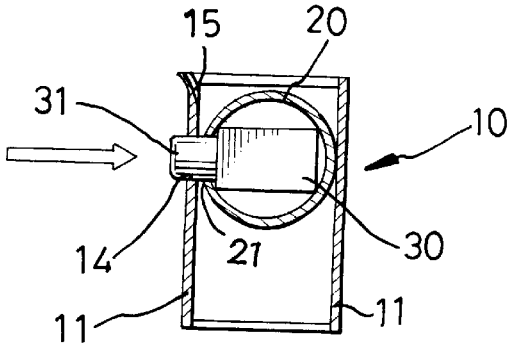
FIG. 6 is a sectional view showing the second lug being pressed.
Figure 3:
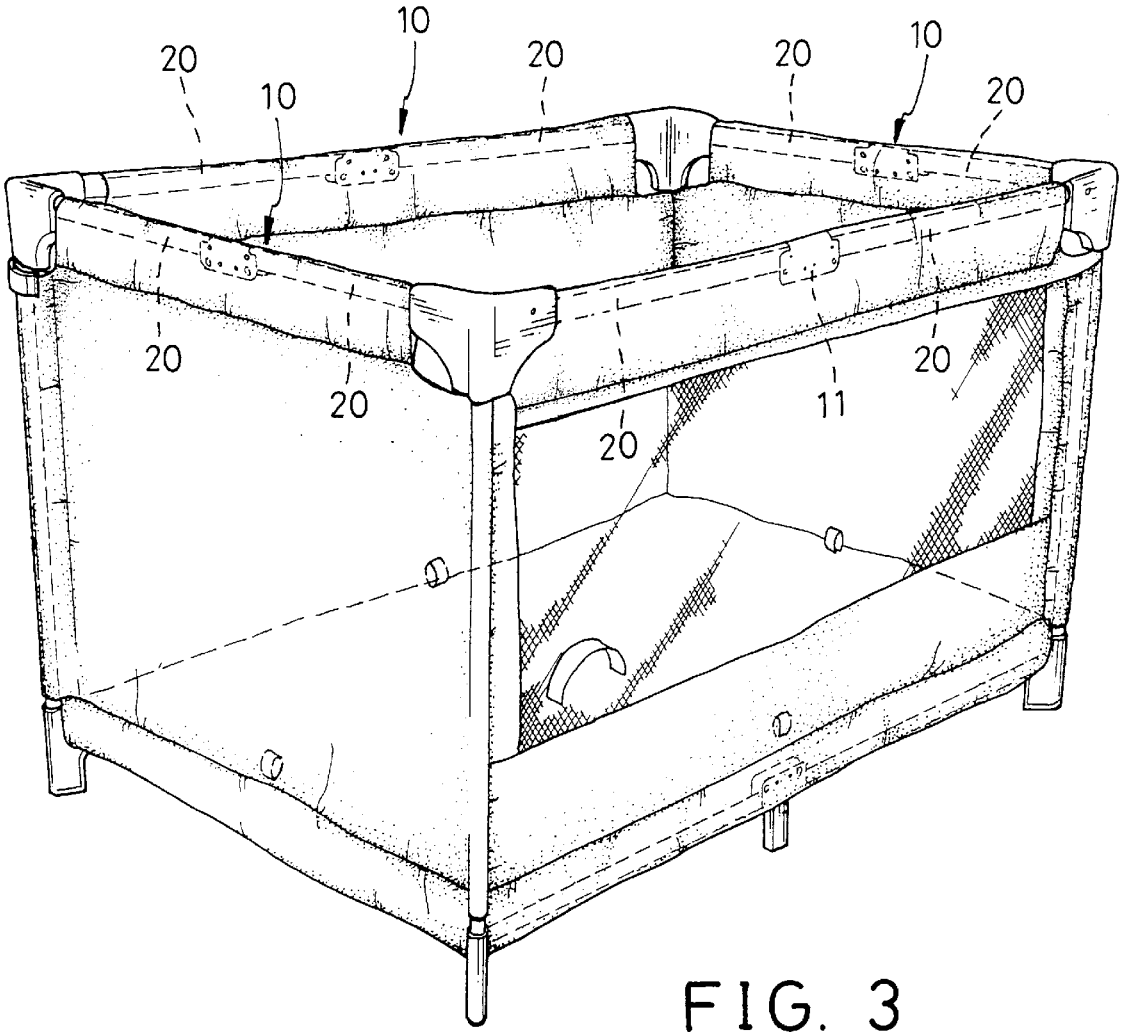
FIG. 3 is a perspective view showing a playpen with the joint of the present invention.
Figure 5:
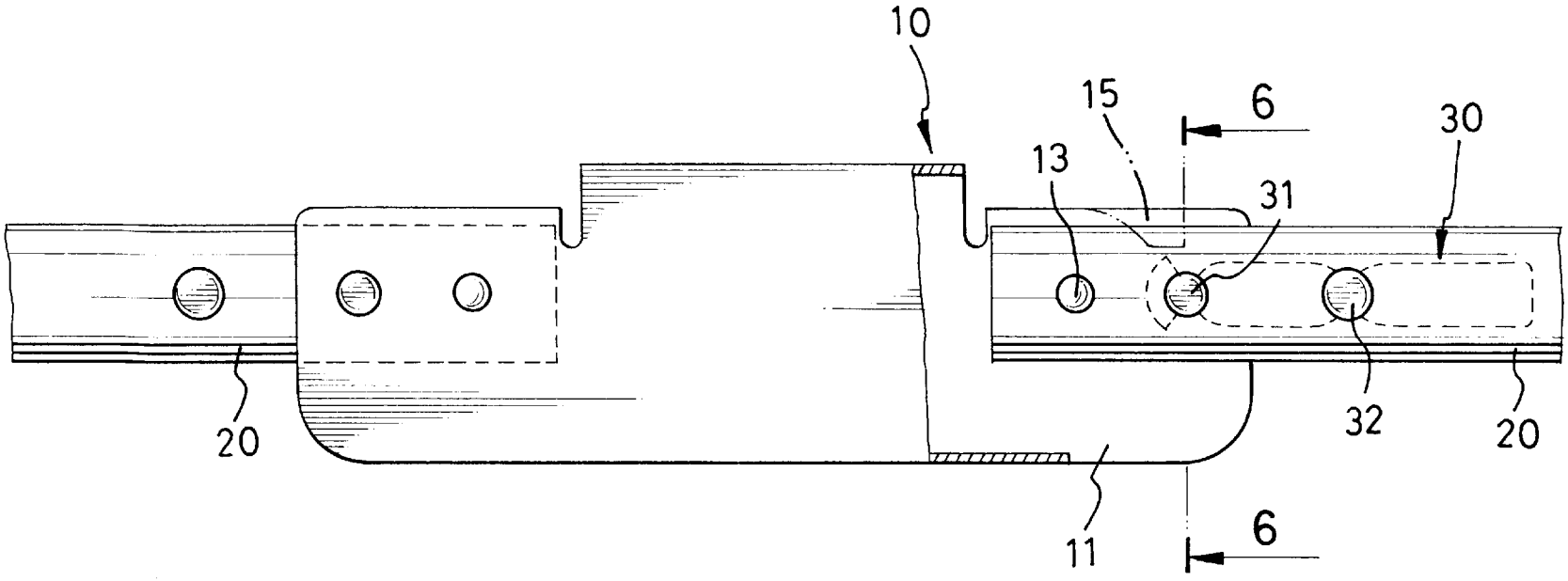
FIG. 5 is a plan view showing the second lug being pressed.

To fold the joint, the rotatable sleeves (40) are firstly rotated to expose the second lug (32), as shown in FIG. 4. The second lug (32) is pressed inwardly, thereby moving the first lug (31) behind the side plate (11), as shown in FIGS. 5 and 6. Therefore, the tube (20) can be pivoted without interference by the first lug (31).

When the playpen is used, because the sleeve is configured to cover the second lug (32) with the shield (43), the lug (32) can not be inadvertently operated, so that the joint will not be folded and harm the baby in the playpen.

Figure 7:
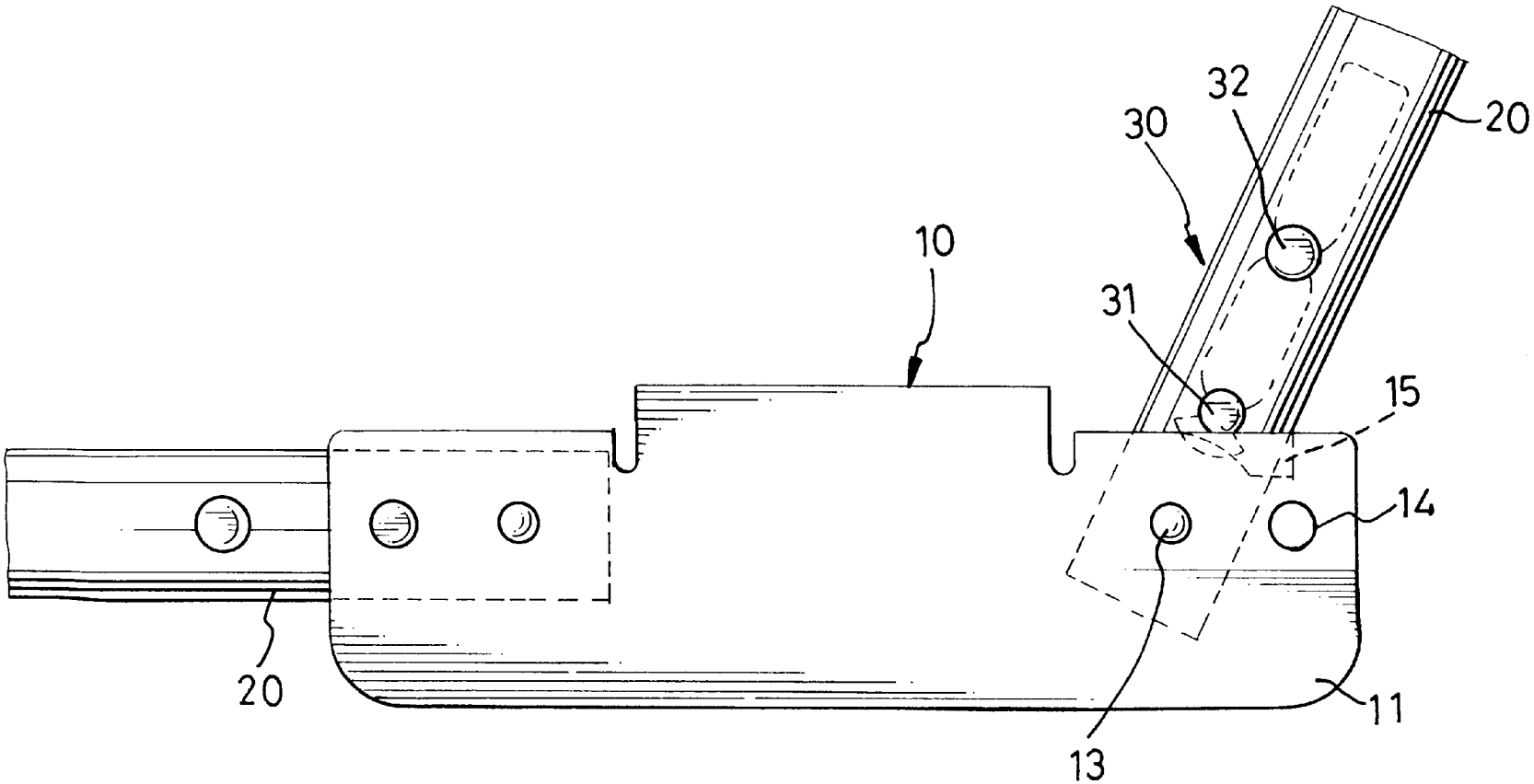
FIGS. 7 and 8 an are plan views showing a tube being pivoted.
Figure 8:
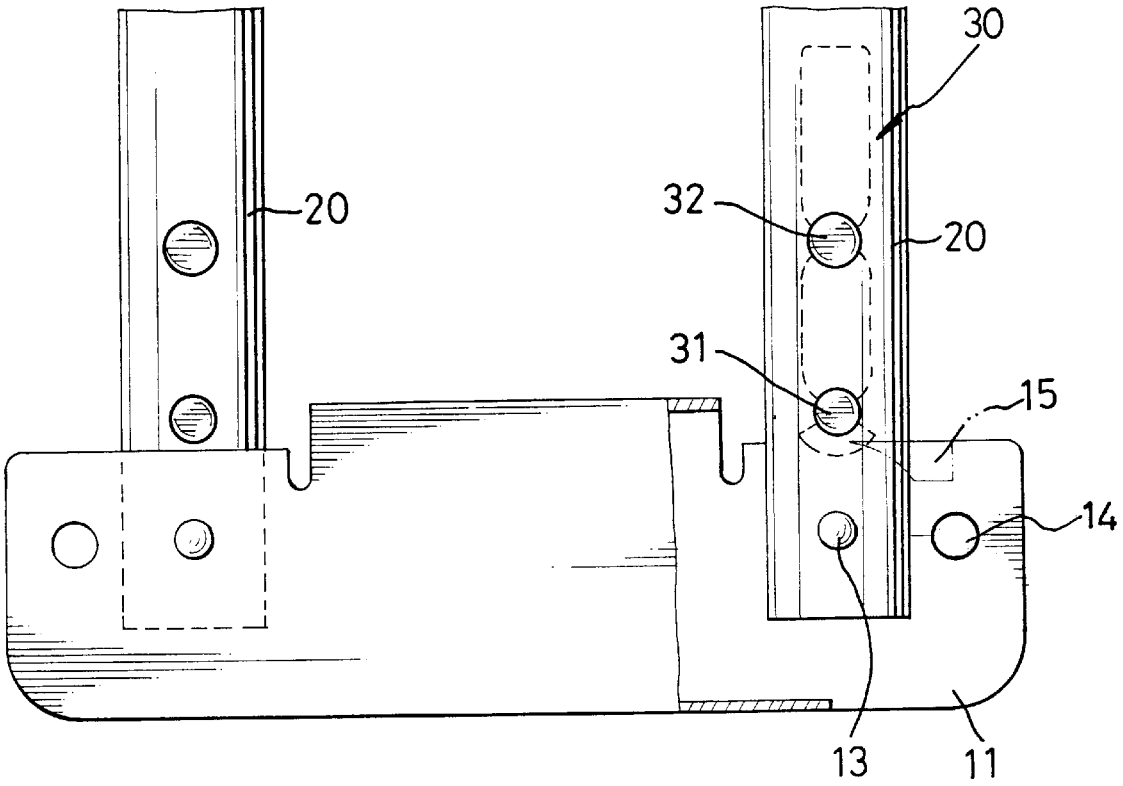

Referring to FIG. 7 and FIG. 8, the guide groove (15) provides a smoothly movement of the first lug (31), when the tube (20) is rotated.

Figure 9:
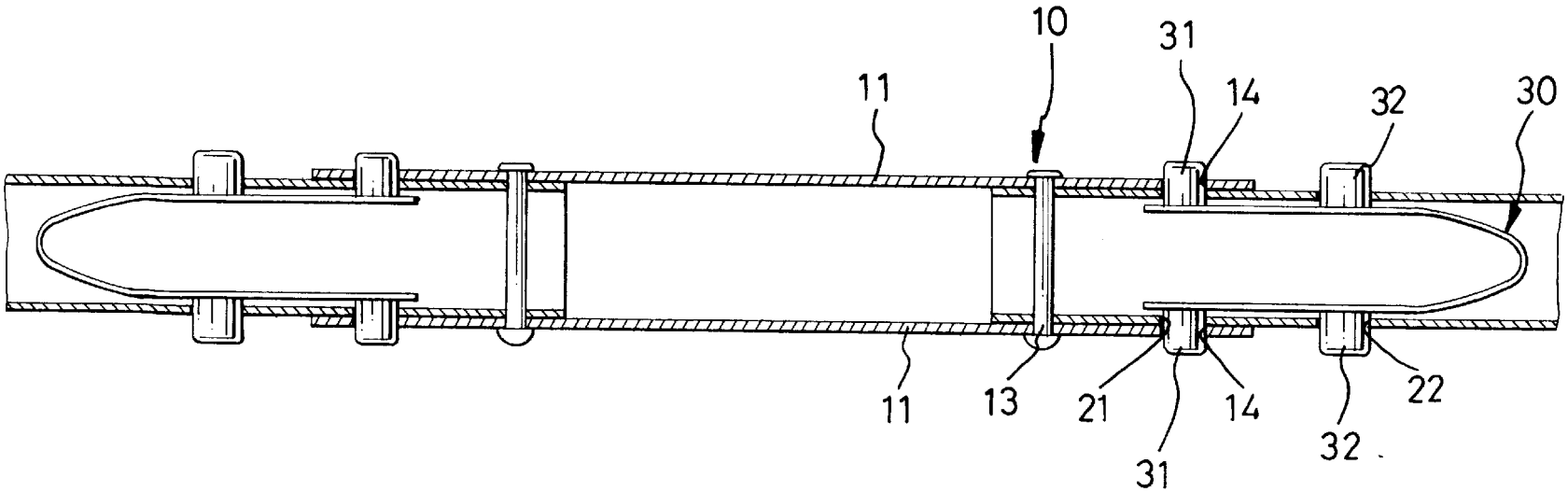
FIG. 9 is a sectional view showing a second embodiment of the present invention.

FIG. 9 shows another preferred embodiment of the present invention. The U-shaped trip (30) has two first lugs (31) and two second lugs (32) respectively formed on both sides thereof, while each of the two side plates has holes (14) defined therein for receiving the first lugs (31).

Figure 10:
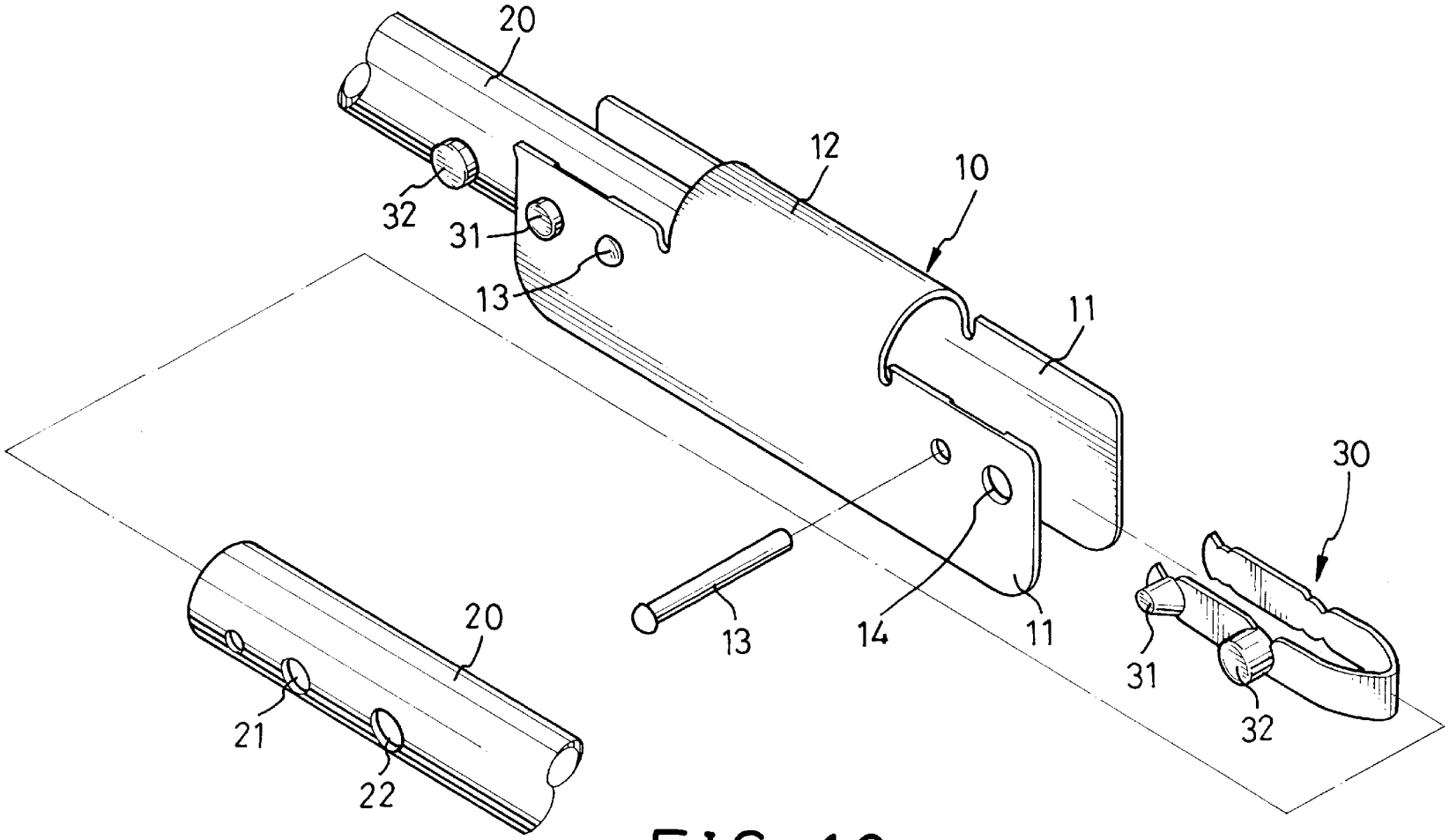
FIG. 10 is a perspective view showing a third embodiment of the present invention.
Figure 11:
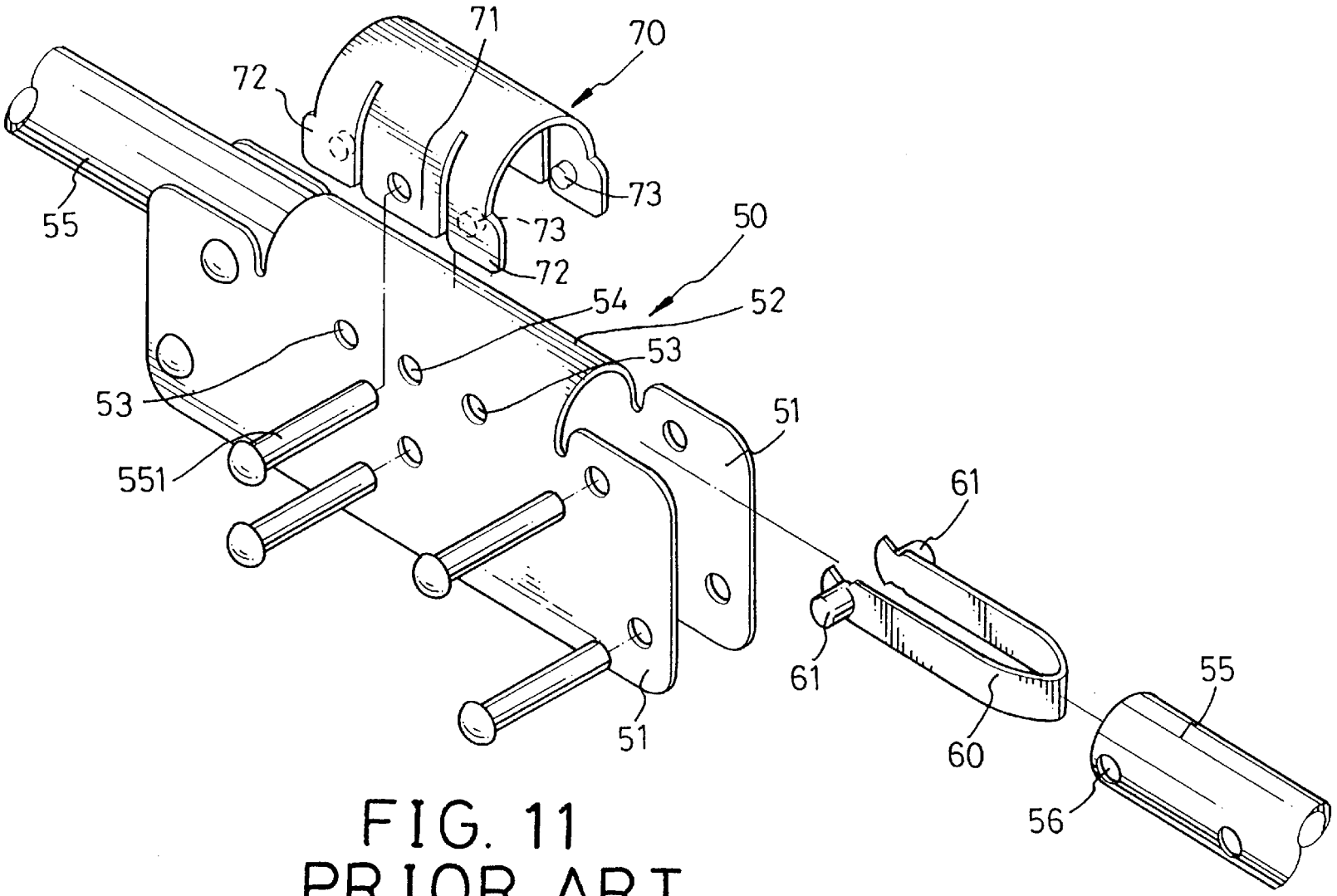
FIG. 11 PRIOR ART
FIG. 11 is an exploded view of a joint of the prior art.
Figure 12:
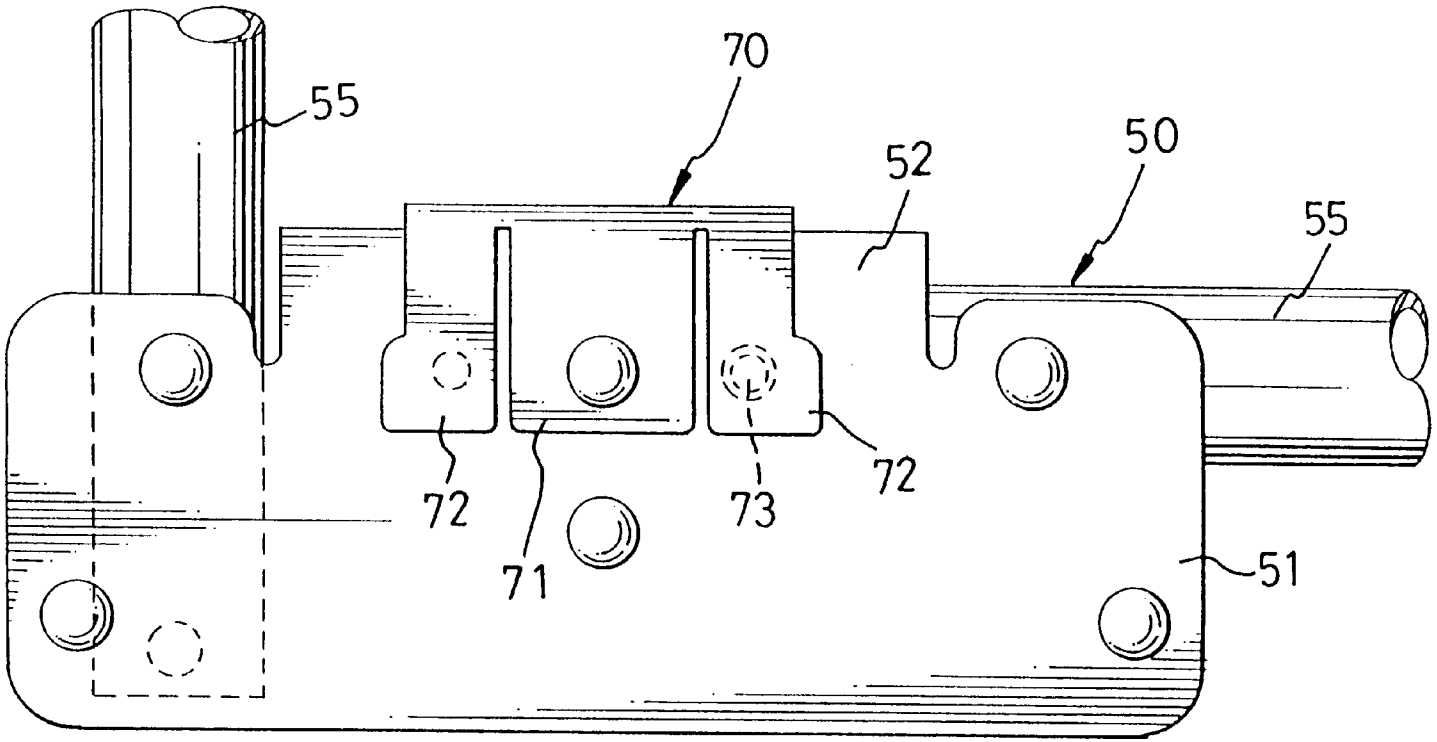
FIG. 12 PRIOR ART
FIG. 12 is a plan view of a joint of the prior art.

FIG. 10 shows another yet preferred embodiment of the present invention. The first lug (31) is configured to have a tapered shape.

The advantages of the present invention are:

1. The height of the second lugs is less than that of the first lugs, so that it is easy to move the first lugs behind the side plate and the tubes are certain to pivot.

2. The baby in the playpen will not be harmed with inadvertently or accidental operation because the second lugs are protected by the sleeve shields.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claim is:

1. A foldable joint for a playpen comprising:

a seat having two spaced part side plates one of which defines holes respectively in both ends and an integral connecting plate;

two tubes respectively pivotally mounted on the end of the seat by a pivot, each having a first aperture and second aperture defined therein; and two U-shaped trips respectively disposed in the tubes, each having a first lug inserted through the first aperture of the tube and the hole of the side plate and a second lug inserted through the second aperture of the tube;

two rotatable sleeves respectively mounted around the tubes each having a channel formed therein for receiving the second lug;

a shield formed above the channel to cover the second lug:

a slot defined therein for receiving a pin to fasten in the tube to axially fix the sleeve; and a tongue formed thereon to facilitate rotating the sleeve;

whereby, the tubes can be folded upwards when the first lugs are pressed inwards.

2. The foldable joint for a playpen as claimed in claim 1, wherein the height of the first lug is less than that of the second lug.

3. The foldable joint for a playpen as claimed in claim 1, wherein the seat defines guide grooves in the internal wall thereof for smoothly folding the tubes.

4. The foldable joint for a playpen as claimed in claim 1, wherein the first lug is a tapered shape.

* * * * *